US008312811B2

(12) United States Patent
Christiansson et al.

(10) Patent No.: US 8,312,811 B2
(45) Date of Patent: Nov. 20, 2012

(54) EXPLOSIVE DEVICE AND METHOD FOR MANUFACTURING SUCH A DEVICE

(75) Inventors: Tor Christiansson, Skeppshult (SE); Erik Isberg, Bjästa (SE)

(73) Assignee: P&P AB, Vastra Frolunda (SE)

( * ) Notice: Subject to any disclaimer, the term of this patent is extended or adjusted under 35 U.S.C. 154(b) by 232 days.

(21) Appl. No.: 12/591,717

(22) Filed: Nov. 30, 2009

(65) Prior Publication Data

US 2010/0147175 A1 Jun. 17, 2010

(30) Foreign Application Priority Data

Dec. 15, 2008 (SE) ..... 0802570-2

(51) Int. Cl.
*F42B 3/00* (2006.01)

(52) U.S. Cl. ..... 102/301; 102/200; 102/202.5; 102/202.7; 102/202.9; 102/275.11; 200/61.08

(58) Field of Classification Search ..... 102/200, 102/202.5, 202.7, 202.9, 275.11; 200/61.08
See application file for complete search history.

(56) References Cited

U.S. PATENT DOCUMENTS 3,831,523 A * 8/1974 Thomas et al. ..... 102/202.11
4,103,619 A * 8/1978 Fletcher et al. ..... 361/248
4,788,913 A * 12/1988 Stroud et al. ..... 102/202.5
4,852,493 A * 8/1989 Boberg et al. ..... 102/202.5
4,944,225 A * 7/1990 Barker ..... 102/202.5
5,370,053 A * 12/1994 Williams et al. ..... 102/202.5
5,413,247 A * 5/1995 Glasa ..... 222/5
5,431,104 A * 7/1995 Barker ..... 102/312
5,452,661 A * 9/1995 Neff ..... 102/202.7
5,682,008 A * 10/1997 Chervinsky et al. ..... 102/202.7
5,714,712 A * 2/1998 Ewick et al. ..... 102/311
5,929,367 A * 7/1999 Neff et al. ..... 102/202.7
5,969,286 A * 10/1999 Ward et al. ..... 102/202.7
7,021,217 B2 * 4/2006 Desai et al. ..... 102/202.5
7,530,312 B1 * 5/2009 Roesler et al. ..... 102/249
7,581,496 B2 * 9/2009 Hennings et al. ..... 102/202.7
2002/0096078 A1 * 7/2002 Goosen et al. ..... 102/202.5
2006/0081146 A1 * 4/2006 Baginski et al. ..... 102/202.5
2008/0038970 A1 * 2/2008 Isberg et al. ..... 441/93
2008/0041259 A1 * 2/2008 Broyer et al. ..... 102/202.11

(Continued)

FOREIGN PATENT DOCUMENTS

DE 19626809 2/1997

(Continued)

OTHER PUBLICATIONS

International Search Report and Written Opinion dated Mar. 17, 2010 for corresponding International Application No. PCT/SE2009/000507.

*Primary Examiner* — Michael Carone
*Assistant Examiner* — Samir Abdosh
(74) *Attorney, Agent, or Firm* — Harness, Dickey & Pierce, P.L.C.

(57) ABSTRACT

The present invention relates to an explosive device comprising an explosive material, and at least one igniting stimulus configured to ignite the explosive material when activated. The explosive device further comprises a sheet of material provided with at least one hole at least partially filled with the explosive material, each hole forms an opening in a first side of said sheet material and said at least one igniting stimuli is arranged on said first side. The invention also relates to a method for manufacturing an explosive device.

20 Claims, 5 Drawing Sheets

U.S. PATENT DOCUMENTS

| | | | | |
|---|---|---|---|---|
| 2008/0148982 | A1* | 6/2008 | Hennings et al. | 102/202.7 |
| 2008/0276819 | A1* | 11/2008 | Desai et al. | 102/202.7 |
| 2009/0151584 | A1* | 6/2009 | Desai | 102/202.7 |
| 2010/0064924 | A1* | 3/2010 | Childs et al. | 102/277.2 |
| 2011/0107934 | A1* | 5/2011 | Rustick | 102/202.7 |
| 2011/0203475 | A1* | 8/2011 | Thuman | 102/275.11 |

FOREIGN PATENT DOCUMENTS

| | | |
|---|---|---|
| DE | 296 06 782 | 9/1997 |
| FR | 2733712 | 11/1996 |
| JP | 9-052568 | 2/1997 |
| WO | WO 2008/013489 | 1/2008 |

* cited by examiner

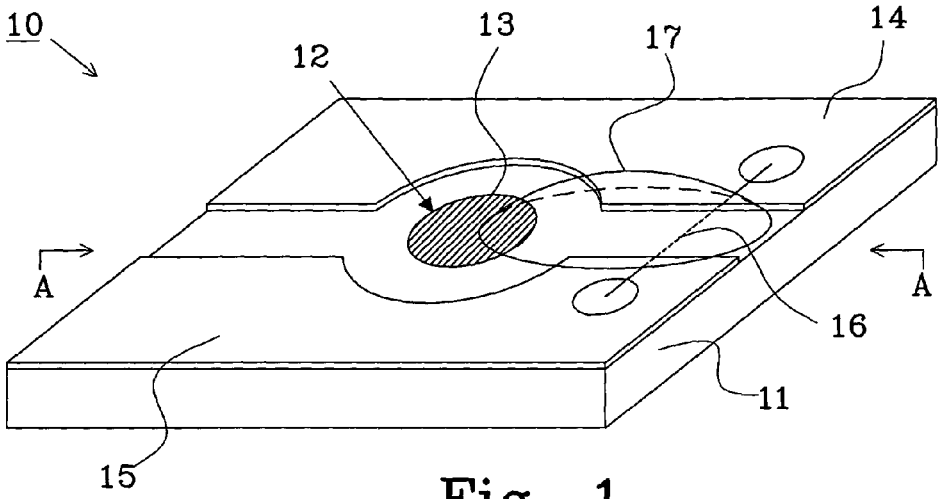
Fig. 1
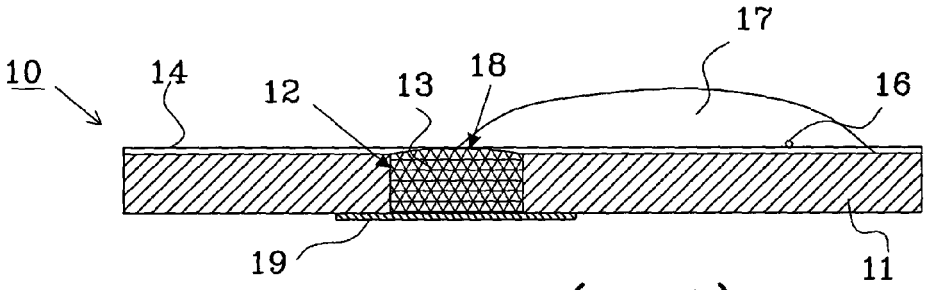
Fig. 2 (A–A)
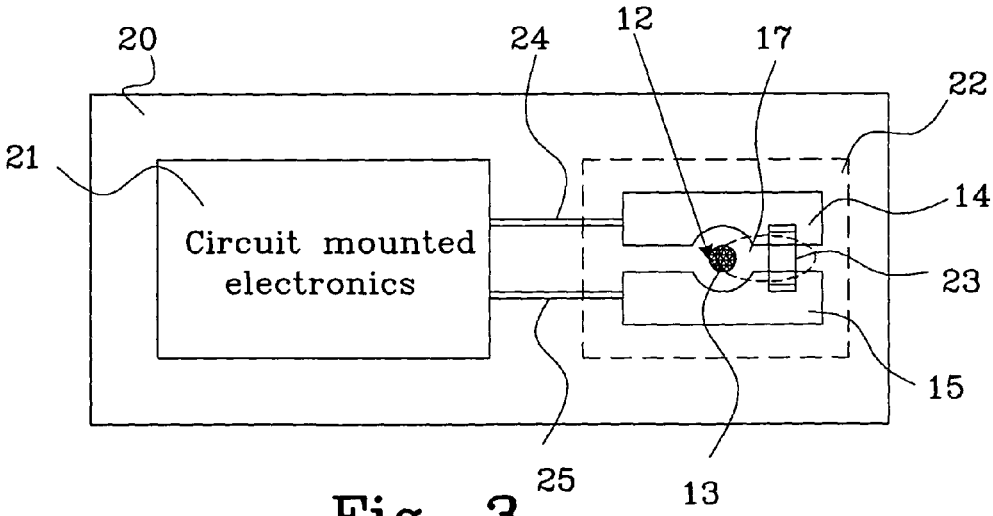
Fig. 3

EXPLOSIVE DEVICE AND METHOD FOR MANUFACTURING SUCH A DEVICE

TECHNICAL FIELD

The present invention relates to an explosive device, especially suitable to be implemented in a planar design, such as a sheet of material. The invention also relates to a method for manufacturing the explosive device.

BACKGROUND

Explosive devices used for penetrating pressurized gas containers, today in combination with inflatable rescue equipment, such as disclosed in the published WO 2008/013489, are rather bulky and have a complex design with many different components.

Other penetrating devices are based on one or more moving components that mechanically penetrate the pressurized gas containers. This requires a complex design in order to ensure proper functionality and as a result of the complex design, the weight is normally rather high.

For instance, U.S. Pat. No. 5,413,247 by Glasa, describes a system wherein a sharp object is mechanically moved using a spring loaded force. Alternatively, the force needed to advance the sharp object could be provided by a pyrotechnical charge. In both cases the dimension of the sharp object will determine the size of the hole.

In addition, a German utility model DE 296 06 782 U1 describes an automatic rescue device for sea and air transport including a water sensor. A puncture device is briefly discussed, which is used to open a pressurized gas cylinder. The puncture device could be implemented as a chemical reaction unit, and more specifically be constructed as a pyrotechnical detonator situated outside a gas management device through which the gas flow when the gas cylinder is opened. A hollow needle could also be used for manually puncturing the closure of the gas cylinder if needed.

The major disadvantage with prior art devices is that they are bulky and have a complex design, with or without moving parts. When implementing an explosive device in a system, e.g. for penetrating a gas cylinder or for igniting a charge in military applications, space is a crucial limitation, and there still exists a need to reduce the size of present explosive devises.

SUMMARY OF THE INVENTION

An object with the present invention is to provide an explosive device which is smaller and easier to manufacture compared to prior art devices.

A solution to the object is achieved by providing a sheet of material with one or more holes having an opening to a first side of the sheet material. The holes are at least partially filled with an explosive material and one or more igniting stimuli configured to ignite the explosive material when activated are arranged on the first side.

An advantage with the present invention is that a very small and compact explosive device may be manufactured compared to prior art devices.

Another advantage with the present invention is that a simple construction with few non-moving components is achieved compared to prior art devices.

Yet another advantage with the present invention is that it has a low weight and is inexpensive to manufacture.

Still another advantage with the present invention is that the explosive device is very stable compared to prior art devices and may be handled easier.

Further advantages and objects will be apparent to a skilled person from the detailed description below.

BRIEF DESCRIPTION OF THE DRAWINGS

FIG. 1 shows a perspective view of a first embodiment of an explosive device.

FIG. 2 shows a cross-sectional view of the explosive device in FIG. 1 along A-A.

FIG. 3 shows a top view of a circuit board provided with electronics coupled to a second embodiment of an explosive device.

Figure 4A:
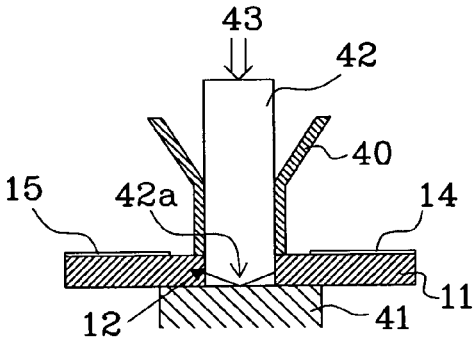
FIGS. 4*a*-4*d* illustrate a method for manufacturing the explosive device in FIG. 1.

It should be noted that the figures in the drawings are not scale, and primarily serves the purpose of enhancing certain details of the invention.

DETAILED DESCRIPTION OF PREFERRED EMBODIMENTS

FIG. 1 shows a perspective view of a first embodiment of an explosive device 10 comprising a sheet of material 11 having a through hole 12 filled with an explosive material 13, such as $AgN_3$ or PETN. Two surfaces 14 and 15 made from a conductive material, e.g. copper, are arranged on the sheet of material 11. A conductor 16, such as an exploding bridge wire (EBW) or an resistive thermal igniter, is electrically connected between the two surfaces 14 and 15, e.g. by soldering, clamping or conductive glue. An ignition transfer material 17 is arranged between the conductor 16 and the explosive material 13 in the hole 12.

It should be noted that it is essential that the two conductive surfaces 14 and 15 are insulated from each other, which in this embodiment is achieved by selecting the sheet of material 11 to have insulating properties, such as a printed circuit board. The explosive device 10 is activated by applying suitable pulse of energy between the conductive surfaces 14 and 15 as illustrated in FIG. 3. The pulse of energy may be an electrical pulse, mechanical pulse or a laser pulse (laser ignition) depending on what type of conductor is used.

FIG. 2 shows a cross-sectional view of the explosive 10 device in FIG. 1 along A-A. The explosive material 13 completely fills the through hole, and there is even some material that extends beyond the through hole as indicated by the bowed shape 18 of the upper part of the explosive material 13. A film 19 is also provided at the lower part of the through hole to provide a seal which prevents the explosive material 13 to migrate from its position within the hole 12.

FIG. 3 shows a top view of a circuit board 20 provided with electronics 21 coupled to a second embodiment of an explosive device 22. The only difference between the embodiment described in connection with FIGS. 1 and 2 is that an exploding foil 23 acts as a conductor between the conductive surfaces 14 and 15. The explosive device in FIG. 3 also comprises a hole 12 completely filled with an explosive material 13, and an ignition transfer material 17 is provided between the conductor and the explosive material 13.

Each conductive surface 14, 15 of the explosive device 22 is connected to the electronics using electrical connection 24 and 25, respectively, which preferably are etched on the circuit board 20. The electronics 21 are preferably surface mounted control electronics that provides suitable energy to activate the explosive device. The electronics may also comprise communication means to receive instructions to activate the explosive device from an external transmitter and/or sensor device.

FIGS. 4*a*-4*d* illustrate a method for manufacturing the explosive device in FIG. 1. In FIG. 4*a*, the non-conductive sheet of material 11 with the through hole 12 and conductive surfaces 14 and 15 is placed on a support 41 in such a way that the upper surface of the support 41 covers the complete opening of the through hole 12 on a second side of the sheet of material 11. A funnel 40 is arranged on a first side, opposite to the second side of the sheet of material 11 and a first end 42*a* of a guiding pin 42 is introduced into the funnel and the through hole, as indicated by arrow 43, to align the small funnel opening with the hole 12.

The guiding pin 42 preferably has a snug fit when introduced into the funnel and have the first end 42*a* has a tapered shape to automatically align the hole and the funnel to each other. The guiding pin 42 is thereafter retracted, leaving the small funnel opening aligned with the hole 12 on a first side of the sheet of material 11, and the support 41 covering the opening of the hole on the second side of the sheet of material 11.

Figure 4B:
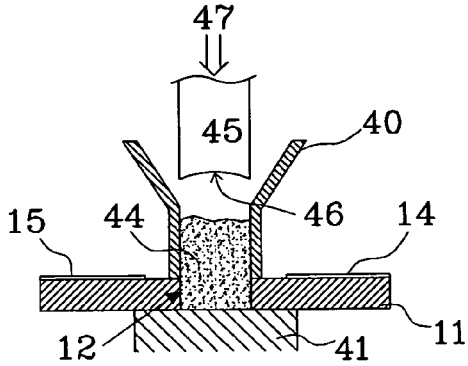

FIG. 4*b* shows the compressing stage of the manufacturing procedure, in which explosive material 44 is provided into the funnel in a loose powdered form. The amount of powder is predetermined and is positioned in the narrow part of the funnel 40. A tool 45 preferably having a concave tip 46 is introduced into the funnel 40, as indicated by arrow 47, in order to compress the powder of loose explosive material 44. The explosive material could be any type of primary explosives, but is preferably $AgN_3$ and $PbN_6$.

Figure 4C:
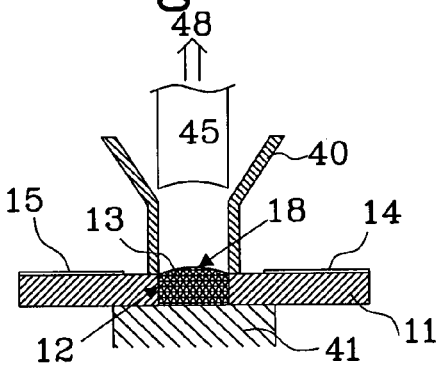
Figure 4D:
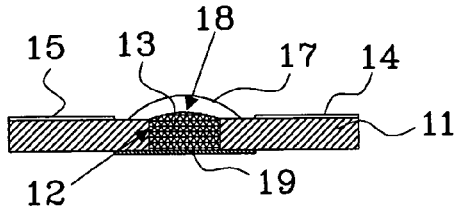

FIG. 4*c* shows the result of the compressing stage when the tool 45 is retracted from the funnel 40, as indicated by the arrow 48. The funnel 40 is thereafter removed and the sheet of material 11 is moved from the support 41. In FIG. 4*d*, a film 19 is mounted to the second side of the sheet of material 11 and a conductor is attached between the conductive surfaces 14 and 15 before the ignition transfer material 17 is arranged over the conductor and the compressed explosive material 13, which completes the process.

However, it should be mentioned that the film 19 on the second side of the sheet material 11 may be attached before the sheet of material is placed on the support 41 as illustrated in FIG. 4*a*. The essential function of the film is to provide a defined interface surface to which additional equipment may be attached, as shown in connection with FIGS. 5*a* and 5*b*.

Figure 5A:
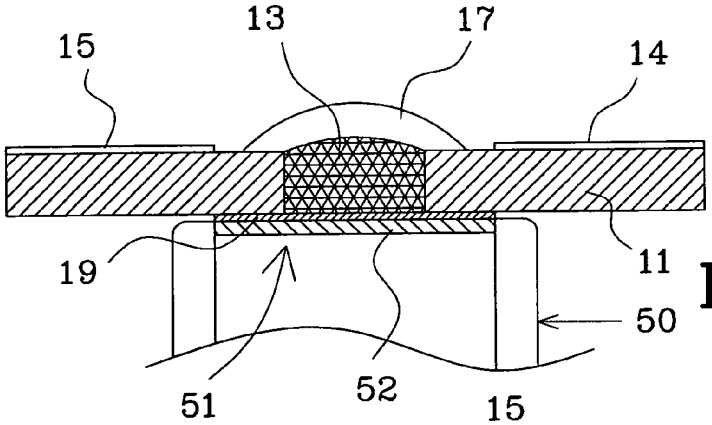
FIGS. 5*a* and 5*b* illustrate the function of the explosive device in FIG. 1 when mounted to a pressurized container of air.
Figure 5B:
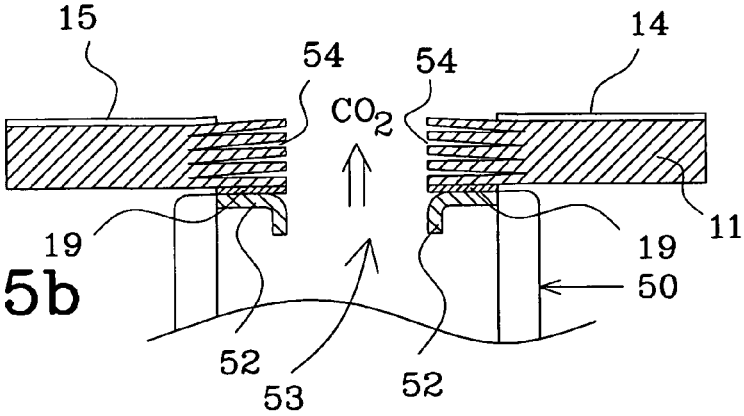

FIGS. 5*a* and 5*b* illustrate the function of the explosive device in FIG. 1 when attached to additional equipment, such as a pressurized gas container 50. Other types of additional equipment, e.g. a fuze, may be attached to the explosive device for military applications.

The film 19 is arranged adjacent to an opening 51 of the pressurized gas container 50, which is covered with a membrane 52. The explosive device is activated by applying a potential between the conductive surfaces 14 and 15, whereby an igniting stimuli, such as a conductor applied between the conductive surfaces 14 and 15, and an ignition transfer material 17 embedding the conductor. The conductor, e.g. a bridge wire, exploding bridge wire or an exploding foil, and the ignition transfer material 17 ignites the explosive material 13 when activated, and the result of the explosion is illustrated in FIG. 5*b*.

The ignition stimuli, i.e. conductor and ignition transfer material 17, and the explosive material 13 are disintegrated after the explosion and an opening 53 is created in the film 19 and the membrane 52 allowing pressurized gas, e.g. $CO_2$, to escape from the pressurized gas container 50 through the explosive device as indicated by the arrow.

Furthermore, it should be noted that some of the energy from the explosion is preferably absorbed in the substrate 11, provided an energy absorbent material is used. The energy absorbent material preferably includes a laminated structure, composite structure, random fibres or ceramics. The energy absorbent material will then expand, e.g. by delaminating the structure as indicated in FIG. 5*b*, see reference numeral 54.

The purpose with the energy absorbing material is mainly to limit the destructive forces on adjacently arranged devices on the substrate and/or the fixture to with the explosive device is mounted. The energy released from the explosion into the substrate is used to delaminate the substrate.

FIGS. 6*a*-6*d* show alternative embodiments of an explosive device according to the invention.

Figure 6A:
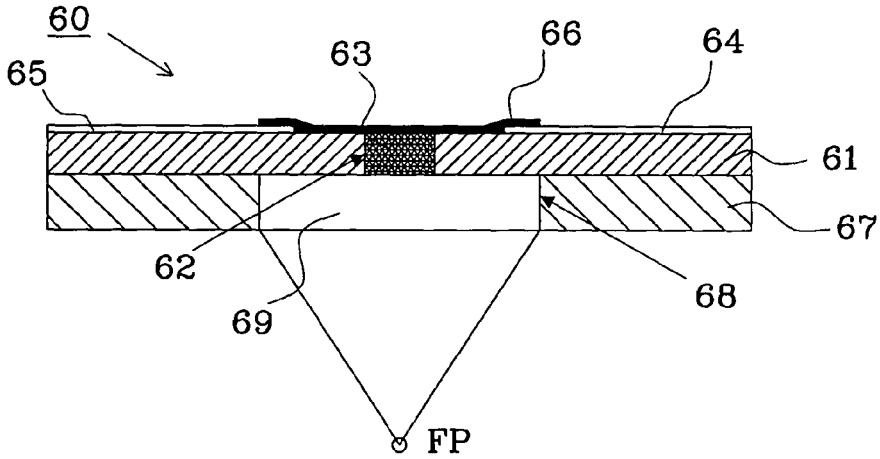
FIGS. 6*a*-6*d* show alternative embodiments of an explosive device according to the invention.

FIG. 6*a* illustrates a third embodiment of an explosive device 60 comprising a main substrate 61 having an opening 62, preferably having a circular cross-section, completely filled with an explosive material 63. Conductive surfaces 64 and 65 are arranged on an upper surface of the main substrate 61 and a conductor 66 is arranged between the conductive surfaces 64 and 65 directly on top of the explosive material 63. The conductor 66 is preferably implemented as a bridge wire, exploding bridge wire (EBW) or an exploding foil, and may be integrated with an plastic material.

The explosive device 60 may be manufactured using a similar process as described in connection with FIG. 4*a*-4*d* with a few exceptions, as illustrated in connection with FIGS. 9*a*-9*d*.

An additional substrate 67 having an additional opening 68 is arranged to the lower surface of the main substrate 61, opposite to the upper surface, and a booster explosive 69, such as PETN, is arranged in the additional opening 68 adjacent to the explosive material 63. The additional opening 68 is preferably circular and wider than the opening 62 in the main substrate 61, to create an explosive device that is self-focusing to a focal point FP, as illustrated in FIG. 6*a*.

Figure 6B:
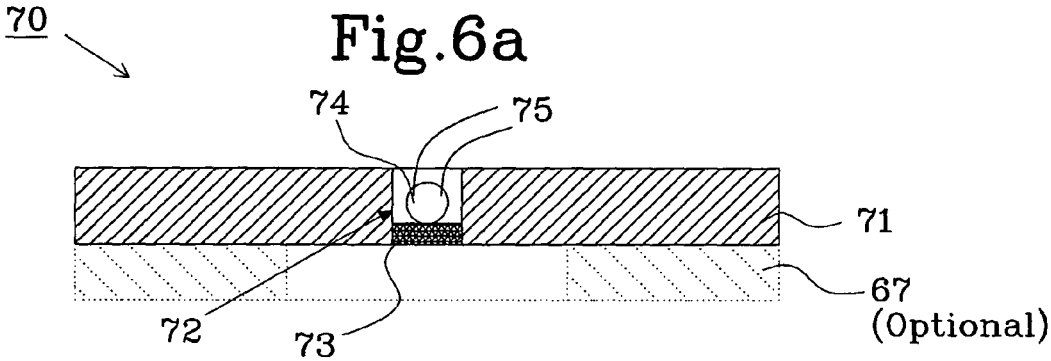

FIG. 6*b* illustrates a fourth embodiment of an explosive device 70 comprising a main substrate 71 having an opening 72, preferably having a circular cross-section, partly filled with an explosive material 73. The thickness of explosive material 73 preferably corresponds to 10-20% of the thickness of the main substrate 71, i.e. if the substrate is 10 mm then the thickness of the explosive material 73 within the opening 72 is 1-2 mm. Thus, it may be necessary to provide a printed circuit board having an increased thickness compared to normal circuit boards, when used as a substrate as illustrated in FIG. 6*b*.

The main substrate 71 has an upper surface and an opposing lower surface, and the explosive material 73 is arranged within the opening 72 at the lower surface of the main substrate 71. An ignition bead 74 is placed within the opening 72 on top of the explosive material 73, and ignition wires 75 connected to the ignition bead 74 extend from the opening 72 and are available at the upper surface of the main substrate 71.

An additional substrate 67 similar to the substrate described in connection with FIG. 6*a* may also be provided.

The use of an ignition bead 74 may lead to a delay, which may be disadvantageous, in contrary to the use of EBW, exploding foil and bridge wire which act instantly when initiated.

Figure 6C:
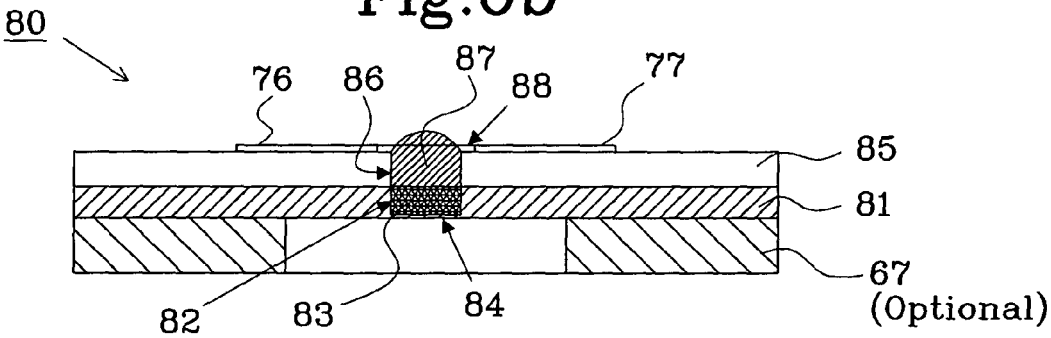

FIG. 6*c* illustrates a fifth embodiment of an explosive device 80 comprising a multilayered structure. A first layer comprises a main substrate 81 having a recess 82 completely filed with an explosive material 83. The recess has an opening in an upper surface of the main substrate 81 and a thin wall 84 separates the explosive material 83 from a lower surface of the main substrate 81. A second layer is arranged to the lower surface of the main substrate 81, which second layer corresponds to the additional substrate 67 having an opening 68 filled with a booster explosive 69 as described above.

A third layer comprises an ignition substrate 85 arranged to the upper surface of the main substrate 81. A through hole 86 is provided through the ignition substrate 85 and aligned with the opening of the recess 82. Conductive surfaces 76 and 77 are provided on the upper surface of the ignition substrate 85, which is made from a non-conductive material. A fuse composition (or ignition material) 87 is provided in the through hole 86 and a conductor 88 is arranged between the conductive surfaces and through the fuse composition 87. The conductor 88 may be implemented as an ignition wire.

Figure 6D:
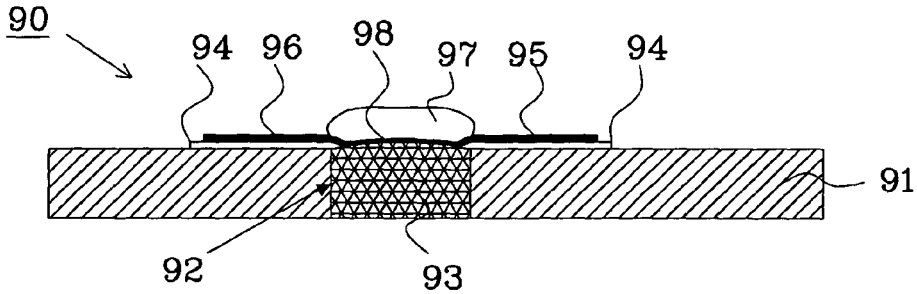

FIG. 6*d* illustrates a sixth embodiment of an explosive device 90 comprising a conductive substrate 91, preferably made from aluminum, having a through-hole 92. An explosive material 93 is provided in the through-hole 92. An electrically insulating material 94 is provided completely around the through-hole 92 on the upper surface to insulate conductive surfaces 95 and 96. A conductor 98 is connected between the conductive surfaces, and a fuse composition (or ignition material) 97 is arranged on top of the conductor and the explosive material 93. An additional layer with a booster explosive may naturally be attached on the lower surface of the substrate 91.

The hole, or recess, in the above described embodiments preferably has a circular opening with a diameter ranging between 0.5-5 mm. less than 150 mg of explosives is preferably used and the thickness of each substrate is preferably less than 10 mm if a printed circuit board is used. The printed circuit board preferably has a laminated structure to absorb energy when the explosive material is activated, and preferably comprises an anisotropic material such as glass fibers and epoxy.

The thickness of the substrate 91 in FIG. 6*d* is preferably less than 2 mm when aluminum is used.

Figure 7:
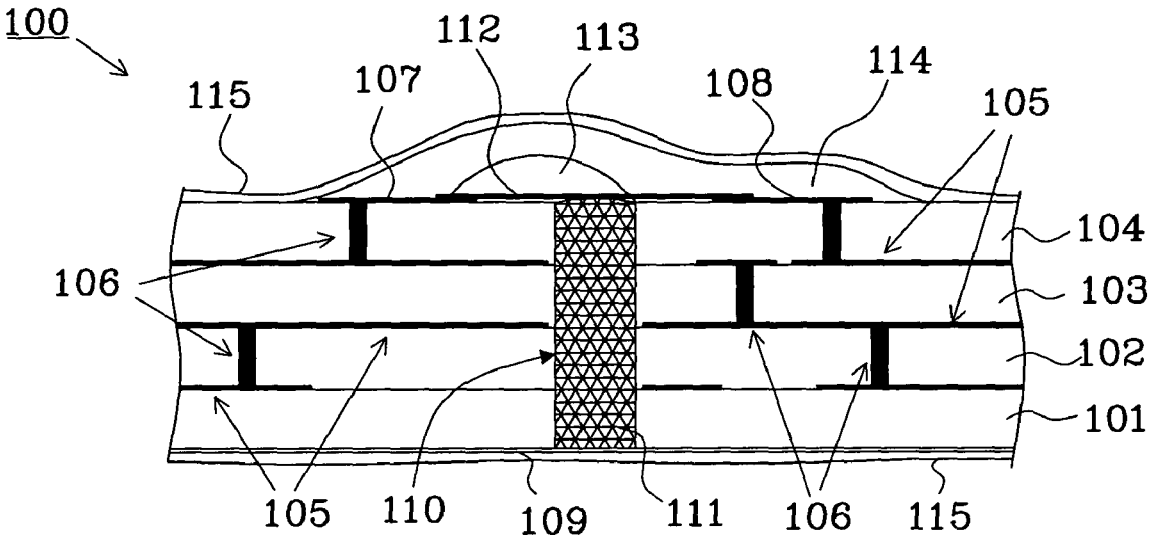
FIG. 7 shows an explosive device in a multilayered structure

FIG. 7 shows an explosive device 100 in a multilayered structure comprising four printed circuit boards 101, 102, 103, 104. Electrical connections 105 are created on the circuit boards and via holes 106 interconnect the electrical connections on different layers. Conductive surfaces 107 and 108 are provided on the upper surface of the circuit board 104 arranged at the top of the multilayered structure, and a film 109 is provided on the lower surface of the circuit board 101 arranged at the bottom of the multilayered structure.

A through hole 110 is arranged through all circuit boards 101-104 and is in this embodiment completely filled with an explosive material 111. A conductor 112 is provided between the conductive surfaces 107 and 108 and an ignition transfer material 113 is arranged over the explosive material 111 and the conductor 112, as described in connection with FIG. 1.

An isolator 114, preferably silicone rubber or Latex®, is provided in the upper surface covering the conductive surfaces 107 and 108 as well as the ignition transfer material 113, the explosive material 111 and the conductor 112. The purpose with the isolator is to confine the moisture sensitive components of the explosive device 100. Furthermore, a conformal coating 115, preferably Parylene®, is provided around the complete explosive device 100 to improve ignition reliability. The purpose of the conformal coating is to isolate the explosive device from a hostile environment and maintain a suitable interior operating environment to ensure proper operation.

Figure 8:
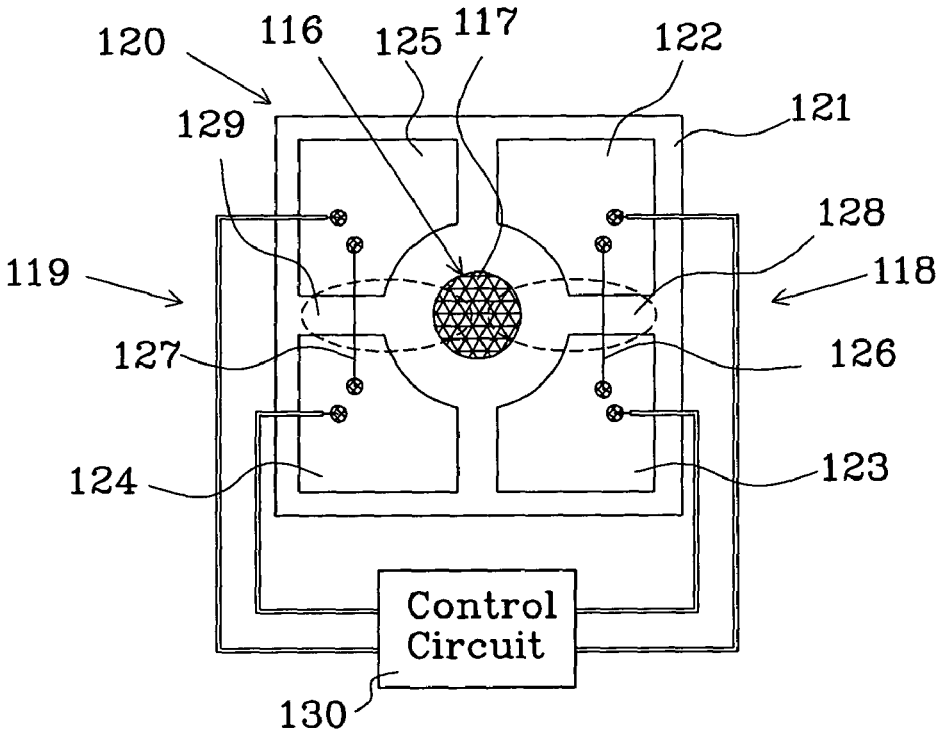
FIG. 8 shows an explosive device provided with two independent igniting stimuli.

FIG. 8 shows a top view of an explosive device 120 provided with two independent igniting stimuli 118 and 119. The explosive device 120 comprises a substrate 121 having four separate conductive surfaces 122, 123, 124 and 125 arranged in relation to a hole 116 being filled with an explosive material 117. A first conductor 126 is connected between conductive surfaces 122 and 123, and a second conductor 127 is connected between conductive surfaces 124 and 125. The conductors are, in this embodiment, exemplified as bridge wires but other types of conductors may naturally be used. A first ignition transfer material 128 is provided between the first conductor 126 and the explosive material 117, and a second ignition transfer material 129 is provided between the second conductor 127 and the explosive material 117.

In this embodiment, the first igniting stimulus comprises the first conductor 126 and the first ignition transfer material 128, and the second igniting stimulus comprises the second conductor 127 and the second ignition transfer material 129. However, it is possible to implement each ignition stimulus without having an ignition transfer material as described in connection with FIGS. 6*a*-6*d*.

The two igniting stimuli 118 and 119 of the explosive device 120 is configured to be connected through wires to an external control unit 130, which may be implemented on the same substrate as the explosive device. The wires connect each conductive surface to the control circuit 130, whereby the control circuitry may independently control the activation of each igniting stimulus 118 and 119.

For instance, the control circuit may initiate the first igniting stimulus 118 and monitor the result of the activation. If the explosive device is not activated due to a malfunction in the first igniting stimulus, the control circuit may initiate the second igniting stimulus to activate the explosive device.

FIGS. 9*a*-9*d* illustrate an alternative process for manufacturing an explosive device, as described in connection with FIG. 6*a*. The process is similar to the process described in connection with FIGS. 4*a*-4*d*, with a few basic differences.

Figure 9A:
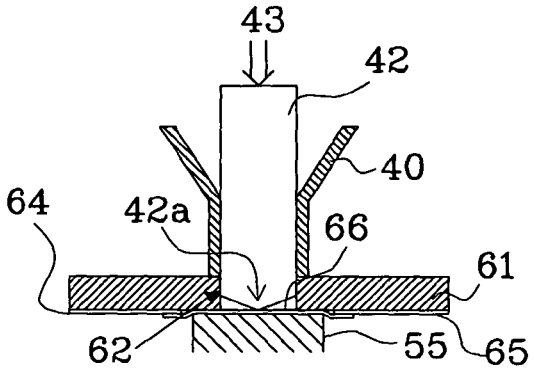
FIGS. 9*a*-9*d* illustrate a method for manufacturing the explosive device in FIG. 6*a*.

The explosive device is manufactured up-side-down as illustrated in FIG. 9*a*. The conductive surfaces 64 and 65 on the substrate 61 are placed downwards, and a plastic film having an integrated conductor 66, such as a bridge wire, is arranged in such a way that a connection is made between the conductive surfaces via the conductor 66 in the film. A support 55 is used together with a funnel 40 and a guiding pin 42 to align the hole 62 with the funnel opening, as described above.

Figure 9B:
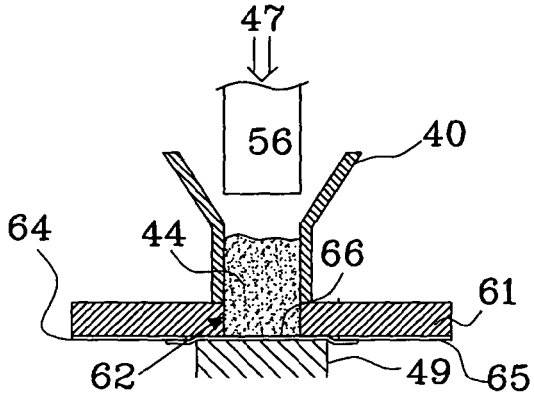

FIG. 9*b* illustrates the compressing stage of the manufacture process, in which a tool 56, preferably having a flat surface, is used to compress the explosive material and bring it into contact with the conductor 66 in the film.

Figure 9C:
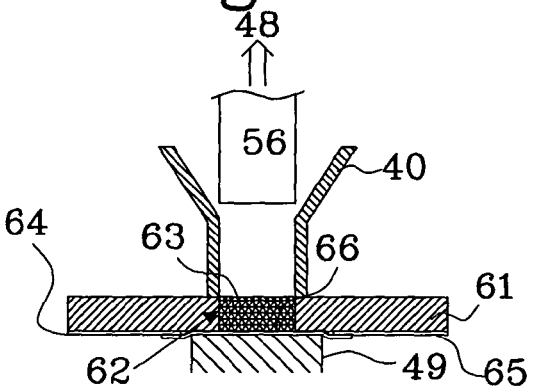
Figure 9D:
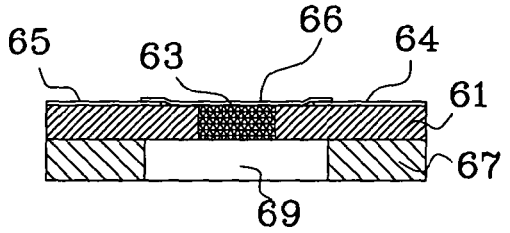

FIG. 9*c* shows the result of the compressing stage when the tool 56 is retracted from the funnel 40, as indicated by the arrow 48. The funnel 40 is thereafter removed and the sheet of material 11 is moved from the support 55 and is flipped over. In FIG. 9*d*, an additional substrate 67 with a booster explosive 69 is attached to the substrate 61 as described in connection with FIG. 6*a*.

Although all previously described embodiments of the explosive device have been exemplified using a flat substrate, the invention should not be limited to this, since it is highly possible that a curved substrate may be used. The explosive device is still based on a sheet of material with a planar surface.

The fuse composition used in combination with a thin wire, e.g. having a diameter of about 0.03 mm, may comprise lead tricinat or lead styphnate.

Another suitable fuse composition preferably comprises:

20 percent DDNP (DiazoDiNitroPhenol) or KDNBF (Potassium dinitrobenzo-furoxan), 20 percent Zirconium powder (micro sized—2 μm)

60 percent Potassium chlorate ($KClO_3$)

A binder of nitrocellulose resin (4%) is added to the mixture.

It should be noted that an essential advantage with the present invention is that a very small amount of explosive material is needed for proper operation compared to prior art devices. As an example, 15 mg of explosive material will have the same effect as 200-400 mg of explosive material in prior art penetrating devices.

The invention claimed is:

1. An explosive device comprising:

at least one circuit board;

said at least one circuit board defining at least one hole;

said at least one hole forming an opening in a first side of said at least one circuit board;

an explosive material filling said at least one hole, said at least one hole in said at least one circuit board being completely filled by said explosive material at least in a plane parallel to said first side of said at least one circuit board; and at least one igniting stimulus configured to ignite said explosive material when activated, said at least one igniting stimulus being arranged on said first side.

2. The explosive device according to claim 1, wherein said at least one circuit board is an energy absorbent material.

3. The explosive device, according to claim 2, wherein said energy absorbent material comprises laminated structure, random fibre or ceramics.

4. The explosive device according to claim 2, wherein said at least one circuit board has a multilayered structure.

5. The explosive device according to claim 4, wherein said at least one circuit board comprises at least one laminated circuit board.

6. The explosive device according to claim 5, wherein said at least one circuit board comprises a plurality of circuit boards arranged to form said multilayered structure.

7. The explosive device according to claim 4, wherein said at least one circuit board is a multilayered circuit board.

8. The explosive device according to claim 1, wherein said at least one hole is completely filled with said explosive material.

9. The explosive device according to claim 1, wherein each hole is a through hole, thereby forming an opening on a second side, opposite to said first side, of said at least one circuit board.

10. The explosive device according to claim 9, wherein a sealing material is provided across the opening on the second side of the at least one circuit board.

11. The explosive device according to claim 1, wherein a first igniting stimulus comprises a conductor connected between two conductive surfaces arranged on said first side of the at least one circuit board.

12. The explosive device according to claim 11, wherein said conductor is a bridge wire, exploding bridge wire or an exploding foil.

13. The explosive device according to claim 11, wherein said conductor is arranged across the opening on said first side and in contact with said explosive material.

14. The explosive device according to claim 11, wherein said igniting stimulus further comprises ignition transfer material arranged between said conductor and said explosive material.

15. A method for manufacturing an explosive device comprising:

providing at least one hole in at least one circuit board, said at least one hole forming an opening in a first side of said at least one circuit board;

filling said at least one hole in said at least one circuit board with an explosive material, said filling being complete at least in a plane parallel to said first side of said at least one circuit board; and arranging at least one igniting stimulus on said first side of said at least one circuit board, said igniting stimulus being configured to ignite said explosive material when activated.

16. The method according to claim 15, wherein selecting said at least one circuit board to be an energy absorbing material.

17. The method according to claim 15, wherein arranging the at least one igniting stimulus comprises arranging a conductor between two conductive surfaces arranged on the first side of the at least one circuit board.

18. The method according to claim 17, wherein the method further comprises arranging the conductor across the opening on said first side and in contact with said explosive material.

19. The method according to claim 17, wherein the method further comprises arranging ignition transfer material between said conductor and said explosive material.

20. The method according to claim 15, wherein said filling with an explosive material comprises providing said explosive material into said at least one hole in a loose powdered form and compressing said loose powdered explosive material in said at least one hole in a direction perpendicular to said first side of said at least one circuit board.

* * * * *